US007350312B1

(12) United States Patent
Grillo

(10) Patent No.: US 7,350,312 B1
(45) **Date of Patent: *Apr. 1, 2008**

(54) DOT MARKS THE SPOT

(75) Inventor: Susan K. Grillo, Orlando, FL (US)

(73) Assignee: Dot Marks the Spot, Inc., Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/698,420

(22) Filed: Jan. 26, 2007

(51) Int. Cl.
*G01B 3/14* (2006.01)

(52) U.S. Cl. ..... 33/613; 33/666

(58) Field of Classification Search ..... 33/613; 248/475.1

See application file for complete search history.

(56) References Cited

U.S. PATENT DOCUMENTS

| | | | | | |
|---|---|---|---|---|---|
| 3,165,283 | A | | 1/1965 | Borisof | 248/29 |
| 3,855,706 | A | * | 12/1974 | Price | 33/431 |
| 3,893,252 | A | | 7/1975 | Chase | 40/158 |
| 4,029,285 | A | | 6/1977 | Tendler | 248/467 |
| 4,206,550 | A | * | 6/1980 | Boyett et al. | 33/286 |
| 4,208,802 | A | | 6/1980 | Berndt | 33/347 |
| 4,220,309 | A | * | 9/1980 | Eisen et al. | 248/542 |
| 4,315,615 | A | * | 2/1982 | Scocozza | 248/489 |
| 4,338,724 | A | | 7/1982 | Johnson | 33/528 |
| 4,345,381 | A | | 8/1982 | Brislin | 33/528 |
| 4,372,050 | A | | 2/1983 | Eisenhauer | 33/528 |
| 4,382,337 | A | | 5/1983 | Bendick | 33/613 |
| 4,455,756 | A | | 6/1984 | Greene | 33/180 |
| 4,512,084 | A | | 4/1985 | Lieberman | 33/180 |
| 4,589,211 | A | | 5/1986 | Policka | 33/DIG. 10 |
| 5,076,612 | A | | 12/1991 | Nirmel | 283/67 |
| 5,238,271 | A | | 8/1993 | Nirmel | 283/67 |
| 5,425,524 | A | * | 6/1995 | Messina, Jr. | 248/475.1 |
| 5,471,760 | A | * | 12/1995 | Farris | 33/613 |
| 5,477,620 | A | | 12/1995 | Barnett | 33/666 |
| 5,498,455 | A | | 3/1996 | Roberts | 428/40 |
| 5,867,917 | A | * | 2/1999 | Karon | 33/613 |
| 6,000,142 | A | * | 12/1999 | Deaton | 33/613 |
| 6,032,378 | A | * | 3/2000 | Null | 33/613 |
| 6,082,018 | A | | 7/2000 | Wells | 33/758 |
| 6,185,831 | B1 | | 2/2001 | Pluciennik | 33/613 |

(Continued)

*Primary Examiner*—Christopher W Fulton
(74) *Attorney, Agent, or Firm*—Brian S. Steinberger; Law Offices of Brian S. Steinberger, P.A.

(57) ABSTRACT

Markers for mounting objects such as picture frames, mirrors, shelves and the like, to desired locations on a wall type surface without causing unnecessary holes to the wall surface. The markers can include target patches with target indicia such as crossed hairs, and bulls-eye patterns. The target patches can have a first adhesive side that is temporarily placed on mounting locations on the rear side of the object. The object with the target patches then is oriented and positioned to a desired optimum location on the wall and then pressed against the wall. Another adhesive side of the target patch that is stronger in adhesion than the first side allows for the target patch to transfer to the wall surface and remain on the wall surface. Nail type fasteners, and the like, then are attached by the location of the target indicia into the wall. Next the object is placed and mounted to the wall mounted fasteners so that the object can then hang from the wall mounted fasteners. The markers can also be used for mounting objects on horizontal surfaces, such as but not limited to floors, tabletops, desk tops, and countertops, and the like.

10 Claims, 12 Drawing Sheets

U.S. PATENT DOCUMENTS 6,473,980 B2 * 11/2002 Ripingill et al. ..... 33/286
6,540,756 B1 * 4/2003 Vaughan ..... 33/27.03
6,572,943 B2 6/2003 Shaffer ..... 428/40
6,574,880 B2 6/2003 Lombardo ..... 33/666
6,782,633 B1 * 8/2004 Cedrone et al. ..... 33/613
6,952,881 B2 * 10/2005 McGivern ..... 33/265
6,971,184 B2 * 12/2005 Prevost ..... 33/613
7,185,442 B2 * 3/2007 Grillo ..... 33/613
2004/0098875 A1 * 5/2004 Gould ..... 33/613
2006/0196069 A1 * 9/2006 Groepper ..... 33/613

* cited by examiner

FIG. 2
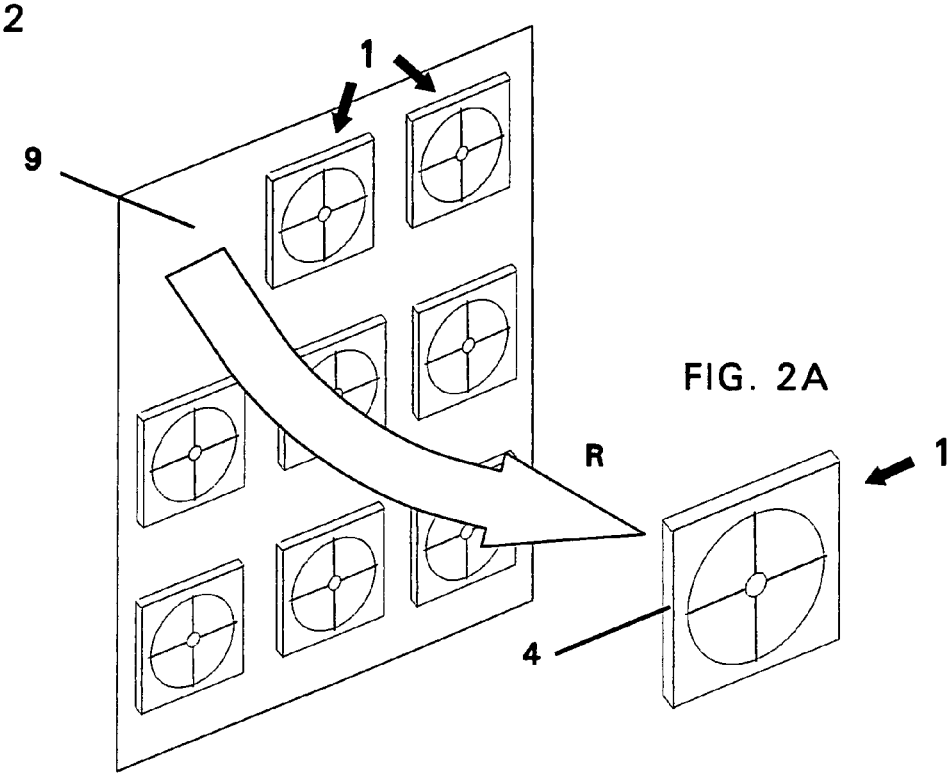
FIG. 2A
FIG. 3
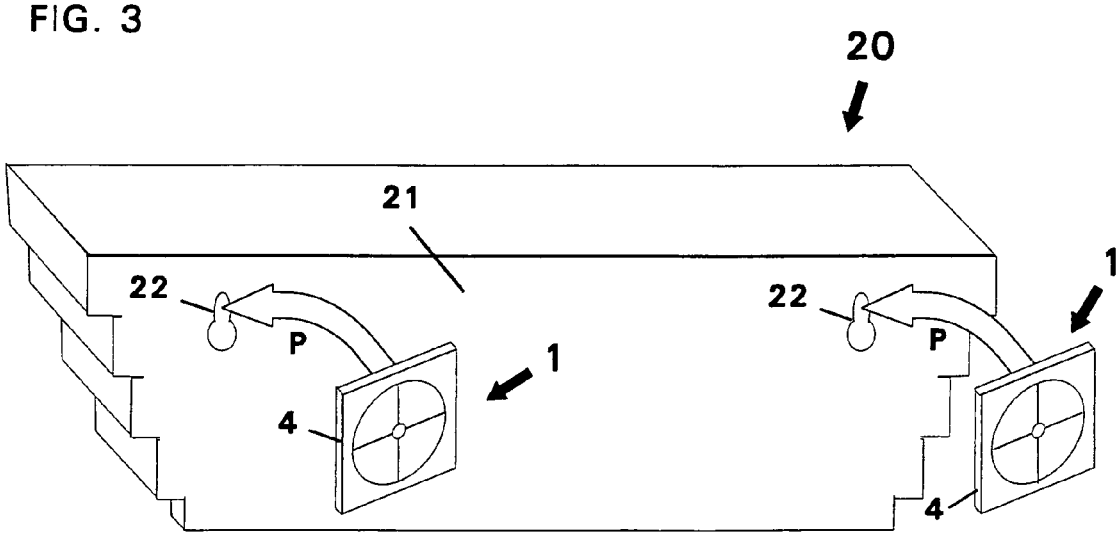

FIG. 6
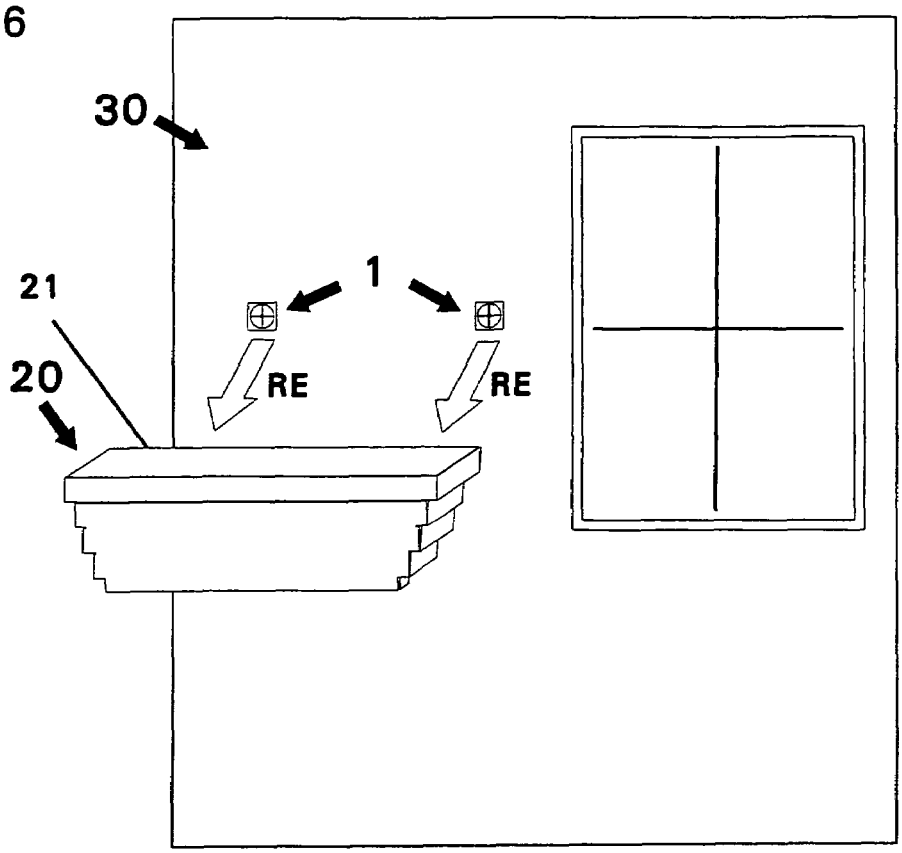
FIG. 7
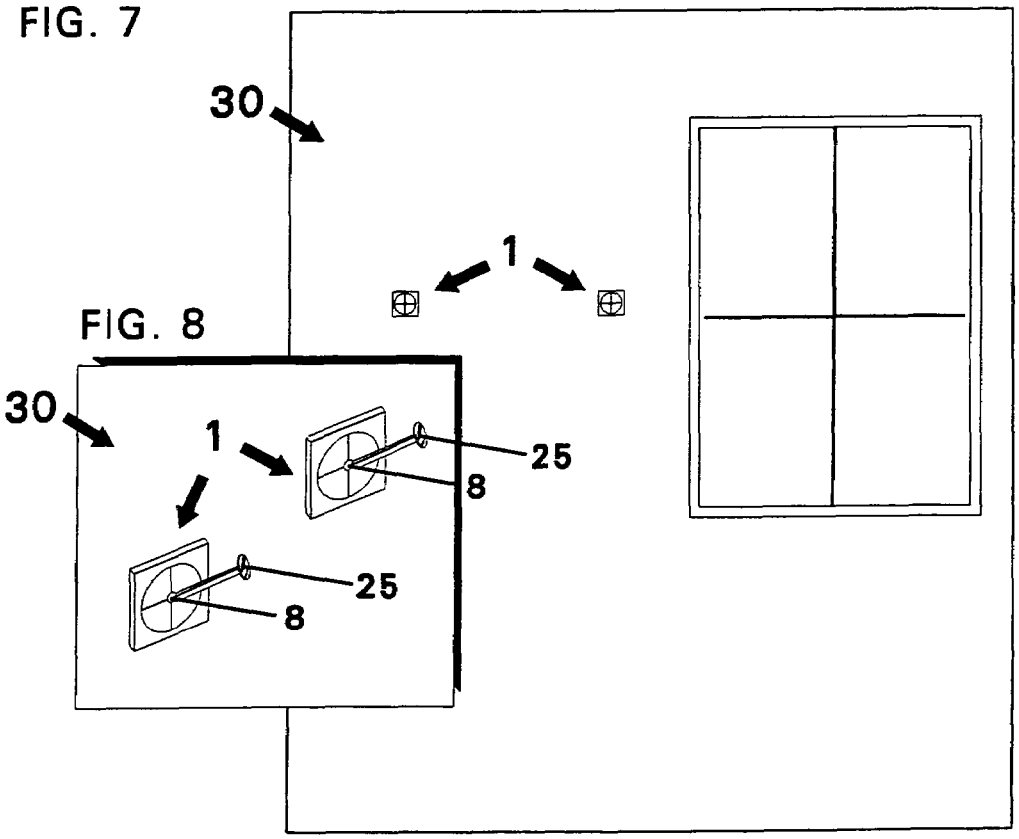
FIG. 8

FIG. 16A
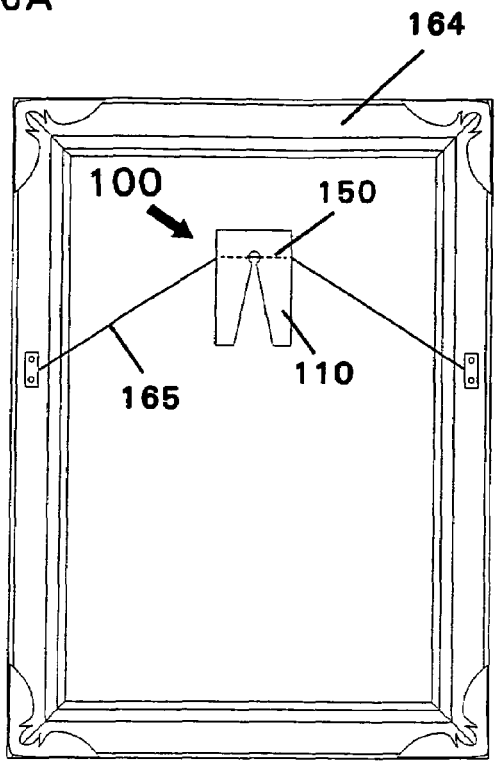
FIG. 16B
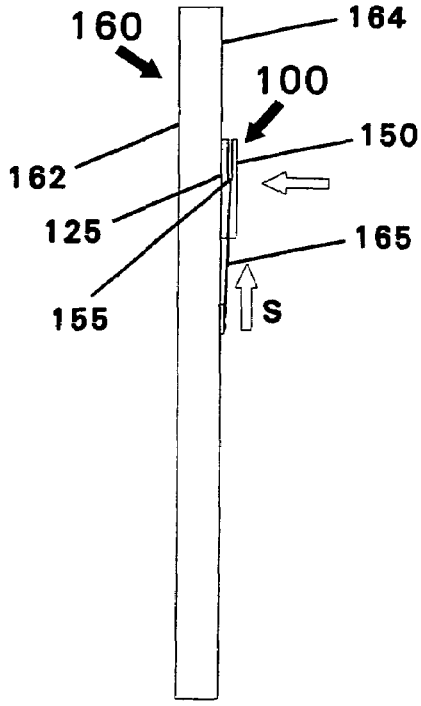
FIG. 17
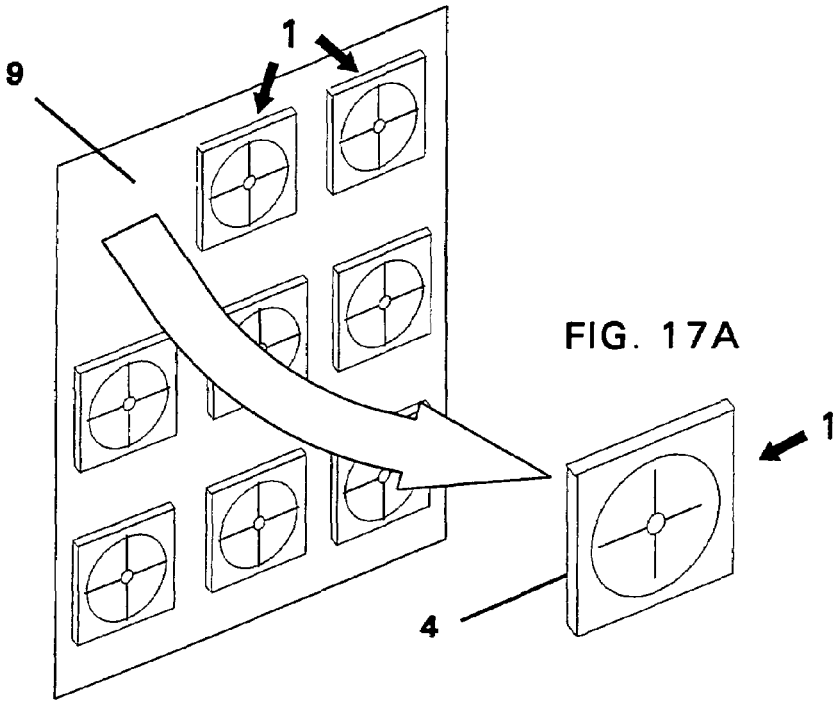
FIG. 17A

FIG. 23A
FIG. 23B
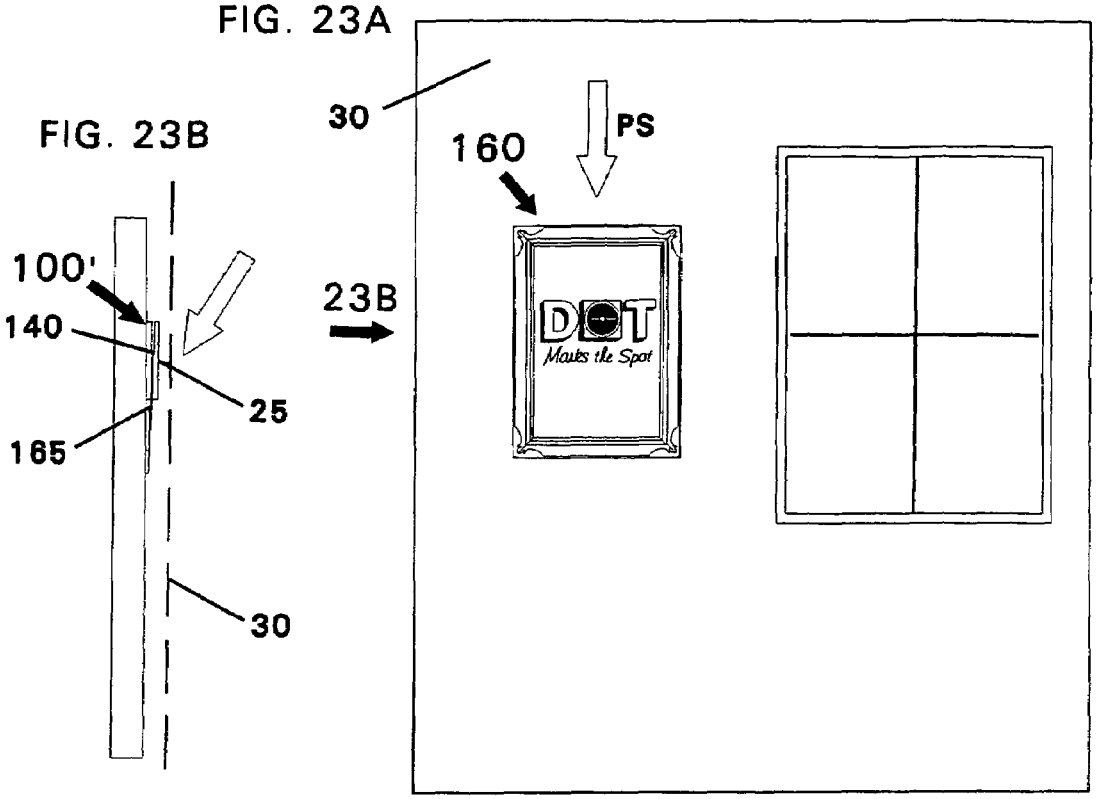
FIG. 24
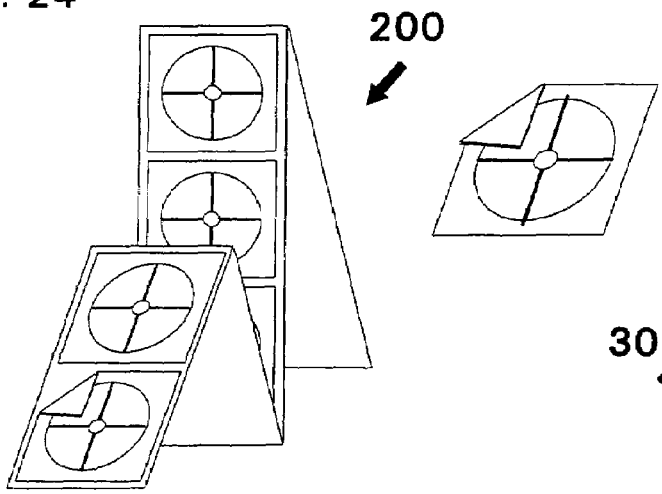
FIG. 25
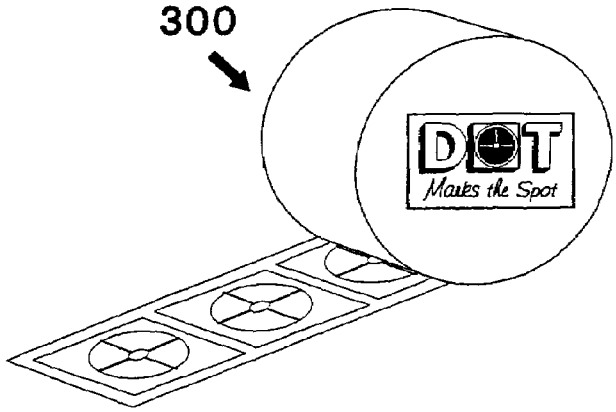

DOT MARKS THE SPOT

This invention relates to markers for mounting objects, and in particular to apparatus, systems and methods for using adhesion markers for vertical wall type surfaces and horizontal type surfaces having targets for placing of hanging devices, such as fasteners such as nails, screws, and hooks thereon, to. aid in mounting frames, pictures and wall hangings on the vertical and horizontal type surfaces.

BACKGROUND AND PRIOR ART

A well known problem with hanging objects such as picture frames, and the like, is where to place on the wall the hanging fastener, such as the nail, the screw, and/or the hook. Typically, installers have been known to try and guest-estimate where the hanging fastener should be placed so that it properly meets the wire, or mounting slot(s) that are located on the rear side of the object which is to be mounted on the wall.

Trial and error often causes the installer to repetitively nail a hanging fastener to the wall, hang the object upon the hanging fastener, and stand back to observe the results. Often, this trial and error procedure ends up in placing undesirable nail type holes in the wall. Additionally, placing of plural hanging fasteners (nails/hooks) is further made more difficult since the installer must additionally estimate how far apart the fasteners should be located from one another. In addition to undesirable holes in the wall the hanging object is often mounted in a tilted and off-level configuration.

Adding a second person may help reduce the time and damage to the wall, but adds the extra expense of utilizing valuable time of a second person to perform the job.

Leveling tools such as bubble levelers in ruler type devices help in mounting objects on walls in a level manner, but fail to overcome the problem of where to properly place the fasteners such as the nails, screws, and hooks on the wall itself.

Various patents have been proposed over the years to aid in hanging objects on walls. See for example, U.S. Pat. No. 3,165,283 to Boris of; U.S. Pat. No. 3,893,252 to Chase; U.S. Pat. No. 4,029,285 to Tender; U.S. Pat. No. 4,208,802 to Berndt; U.S. Pat. No. 4,455,756 to Greene; U.S. Pat. No. 4,512,084 to Lieberman; U.S. Pat. No. 5,076,612 to Normal; U.S. Pat. No. 5,238,271 to Normal; U.S. Pat. No. 5,498,455 to Roberts; U.S. Pat. No. 5,477,620 to Barnett; U.S. Pat. No. 6,185,831 to Pluciennik; U.S. Pat. No. 6,572,943 to Shaffer; U.S. Pat. No. 6,574,880 to Lombardo; However, none of these patents overcomes all the problems with the prior art described above.

Thus, the need exists for solutions to the above problems with the prior art.

SUMMARY OF THE INVENTION

A primary objective of the present invention is to provide a marking device, apparatus, system and method for optimally mounting an object, such as a picture, frame, mirror, sconce, and shelf on a vertical wall type surface or horizontal surface, which would enable a single installer to mark a single spot on the wall without causing multiple and undesirable holes on the surface.

A secondary objective of the present invention is to provide a marking device, apparatus, system and method for mounting a hanging fastener such as a nail, screw and hook thereon, that matches up to the rear mounting portion, such as a wire, slot, or the like, on the object, such as a picture, frame, mirror, sconce or shelf that is to be hanged.

A third objective of the present invention is to provide a marking device, apparatus, system and method for optimally mounting an object, such as a picture, frame, mirror, sconce or shelf, without requiring an extra step of having the installer to step back and observe the location of the hanged object before determining the optimum location of the hanged object.

A marker for determining a mounting position on a wall on which objects are to be mounted thereon can include a sheet material having a front with a sticky adhesive surface, and a back with a sticky adhesive surface, and target indicia visible on either or both the front or the back side, wherein the sheet material being placed on the wall allows for positioning of a fastener through the center of the target indicia.

The sheet material can be transparent or opaque. The sheet material can be formed from a tape such as a plastic or acrylic sheet material, or a paper material, or combinations thereof, and the like.

The target indicia can have a central hole and/or a bull's eye target having concentric circles with or without a central hole. Alternatively, the target indicia can have a cross-hair configured target having crossed lines with or without a central hole.

Methods of using the novel invention can include attaching one side of a transferable target to a back side of an object to be hanged. Next the object to be hanged can be pressed against a wall surface so that an opposite more stronger(aggressive) adhesive side of the target is then pressed and transferred against a wall surface. Next, the object can be removed from the wall surface which results in the target being transferred onto the wall surface. Finally, a hanging fastener, such as a nail, a screw, or a hook is positioned in the center of the target indicia into the wall, and the object is then mounted to the wall by being hung from the wall mounted fastener.

The targets can come from a dispenser having a roll of sheet materials. The sheet materials can have perforated edges between adjacent targets wherein a user separates the targets from one another by tearing one from another.

Another version can have a wire hanging patch attached to a rear side of a frame having a wire hanger. The wire patch supports a central portion of the wire by adhering to a rear side of the frame. Next the transferable target patches can be attached to a rear exposed side of the wire hanging patch, and the can be transferred to the wall surface as previously described.

Further objects and advantages of this invention will be apparent from the following detailed description of the presently preferred embodiments which are illustrated schematically in the accompanying drawings.

BRIEF DESCRIPTION OF THE FIGURES

FIG. 2 is a perspective view of a sheet of novel target patches.

FIG. 2A is an enlarged view of a single target patch from the sheet of FIG. 2.

FIG. 3 is a perspective view of the target patches being applied to the back of a shelf.

FIG. 6 is a front perspective view of the shelf being removed from the wall.

FIG. 7 shows the target patches now attached to the wall.

FIG. 8 is an enlarged view of hanging fasteners being mounted through the target patches.

FIG. 16A is a rear view of the picture frame with wire hanging patch in place.

FIG. 16B is a side view of the frame with patch of FIG. 16A along arrow 16B. in place.

FIG. 17 is a perspective view of a sheet of novel target patches of the preceding figures.

FIG. 17A is an enlarged view of a single target patch from the sheet of FIG. 17.

FIG. 22 is an enlarged view of a fastener inserted through the wall attached target patch.

FIG. 23A is a front view of the picture frame now attached to the wall.

FIG. 23B is a side view of the frame attached to the wall of FIG. 23A along arrow 23B.

FIG. 24 is a perspective view of a strip of target patches.

FIG. 25 is a perspective view of a dispenser holding a rolled up strip of target patches.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

Figure 1A:
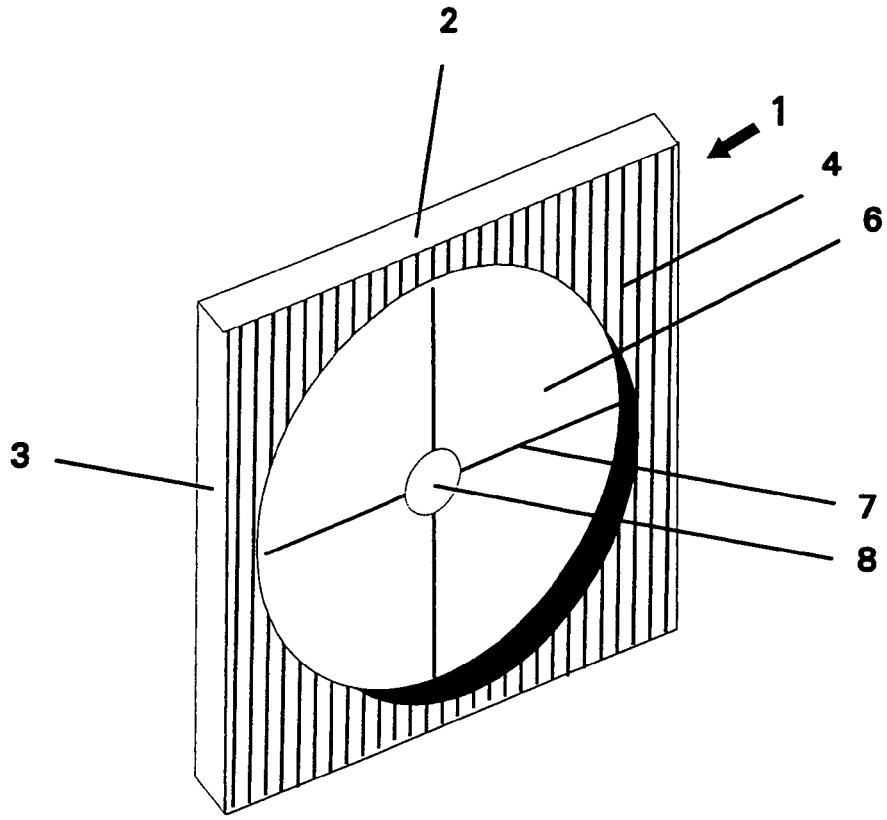
FIG. 1A is a perspective rear view of one embodiment of the novel target patches
Figure 1B:
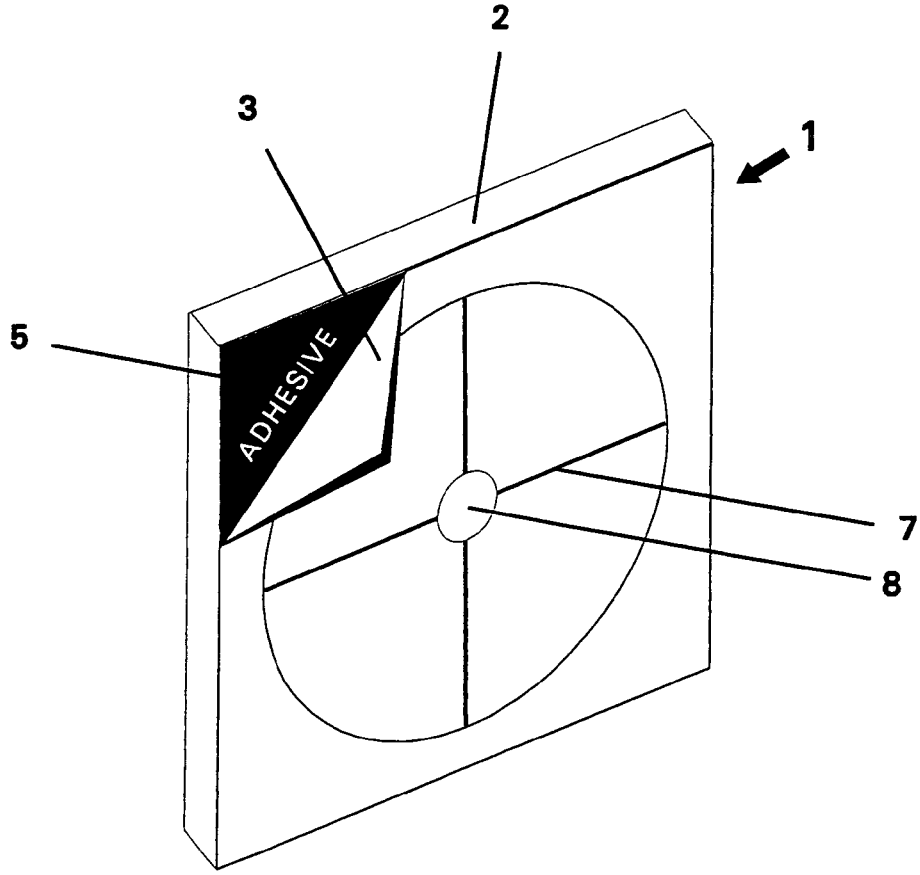
FIG. 1B is a perspective front view of the target patch of FIG. 1A.

F*ig*. 1A is a perspective rear view of a novel target patch 1. FIG. 1B is a perspective front view of the target patch 1 of F*ig*. 1B. FIG. 2 is a perspective view of a sheet of novel target patches. FIG. 2A is an enlarged view of a single target patch from the sheet 9 of FIG. 2.

Referring to Figures 1A, 1B, 2 and 2A, a novel target patch 1 can be a thin patch having a thickness of less than approximately ½ of an inch, and outer dimensions of no more than a few inches in length and width. The novel target patch 1 that is shown can have a square/rectangular frame portion 2 that can be formed from materials such as but not limited to cardboard, paper, plastic, foam, combinations, thereof, and the like, with one side surface 4 having a sticky surface, such as an adhesive surface formed materials used with Post It®, and the like, and an opposite side surface 3 that can be a peelable backing layer, such as but not limited to paper, and the like, that when peeled off reveals another sticky adhesive surface 5 underneath. A larger sheet backing 9, such as but not limited to paper, cardboard, and the like, can be used as the backing for back surface 4 on the frame portion, so that the rear sticky surface 4 of a single target patch 1 can be removed therefrom.

The invention can be practiced where exposed sticky side surface 5 has a slightly stronger adhesive than that of exposed sticky side surface 4.

For example sticky side surface can have an adhesive coating across substantially all of the surface area 5, while side surface 4 has less surface area being coated. For example, surface area can have V2 the area covered. Thus, side 5 can adhere to another surface stronger than side 4 can adhere.

Alternatively, both sides of the target patch can have the same amount of adhesive, with one side having a thin sheet of a target indicia placed thereon. Thus, the side with a centrally located target indicia strip will only have adhesive along side the strip, while the other side has adhesive across the entire side surface.

An example of a temporary sticky adhesive surface can be a removable adhesive. For example, the invention can use the self stick removable adhesives sold under the mark Highland tm, manufactured by 3M, and the like. The target indicia can be used with double coated removable foam tape such as that sold by under the label Adhesive 100 4658F by 3M, which can be modified so that one side of the tape can have more adhesive than an opposite side surface of the tape.

In the middle of the frame portion 2 can be a transparent sheet type layer 6 such as plastic type thin layer material, and the like, on which target indicia 7, such as a cross-hair, is printed. In the center of the target indicia 7 can be a through-hole 8 in which fasteners, such as nails, screws, and the like, which will be described later, can be positioned therethrough.

FIG. 3 is a perspective view of the target patches 1 being applied to the back of a shelf 20. The novel invention target patches can be used to aid in hanging and aligning object that can be wall mounted such as but are not limited to pictures, frames, mirrors, sconces, shelves, curtain rods, and the like. Here, just for purposes of illustration, rear exposed sticky surfaces 4 of the target patches can be placed in the direction of arrows P against existing hanging slots 22, such as keyhole shaped slots, on a back surface 21 of a shelf type object 20. Next the backing layer 3 (shown in FIG. 1B) can be removed from the target patches 1 to remove another sticky surface 5.

Figure 4:
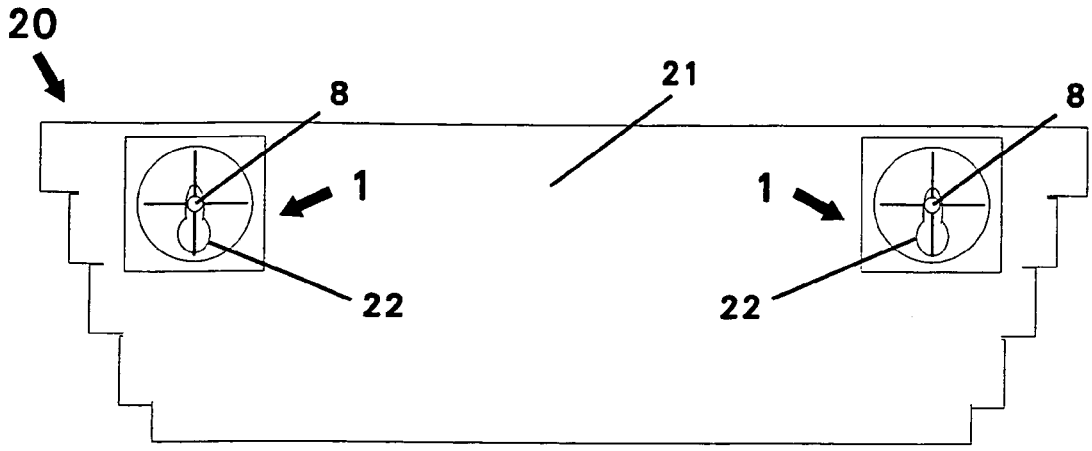
FIG. 4 shows the target patches attached and centered over the hanger slots on the back of the shelf

FIG. 4 shows the target patches 1 attached to the back 21 of the shelf type object 20 so that the through-holes 8 on the target patches 1 are aligned with the upper opening portions of the existing keyhole slots 22 on the rear of the shelf type object 20.

Figure 5:
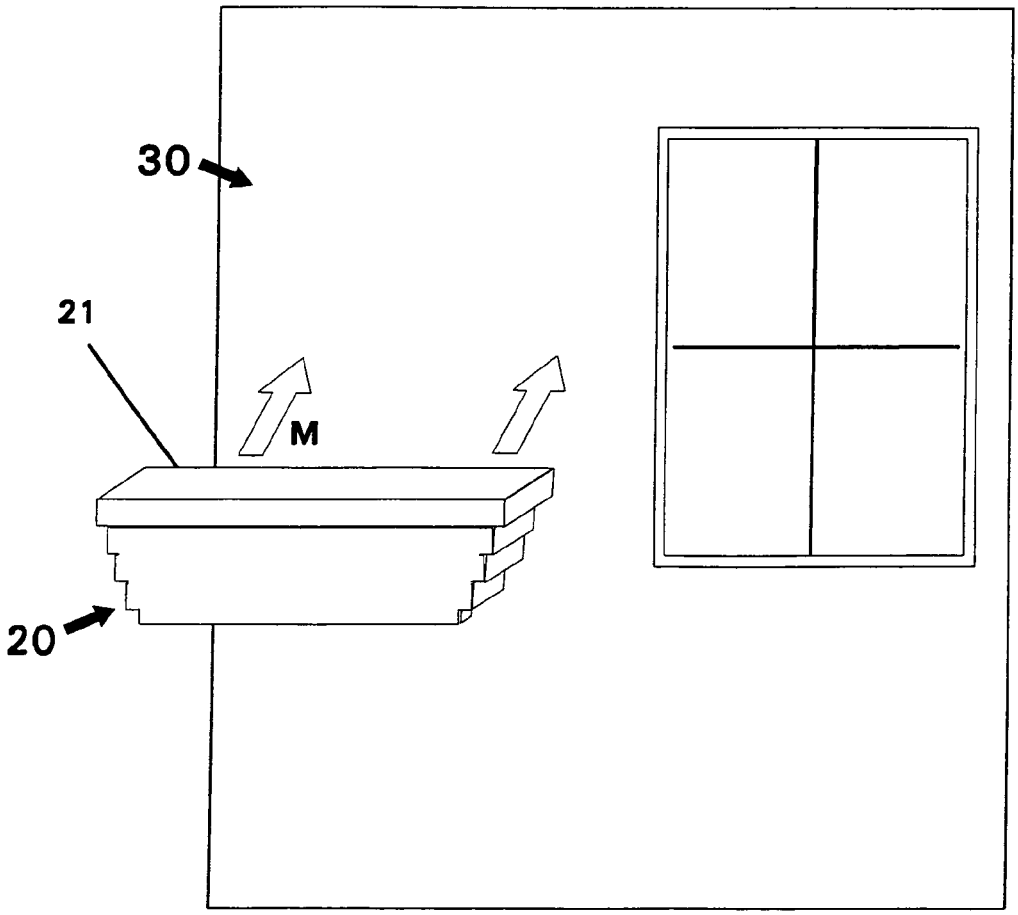
FIG. 5 is a front perspective view of the shelf about to be pressed against a wall.

FIG. 5 is a front perspective view of the shelf type object 20 being moved in the direction of arrow M into position so that the rear side 21 of the shelf object 20 is to be pressed against a selected location on a wall surface 30. As the object 20 is being placed against the wall 30, the installer can orient and shift the object to an optimum and selected location where the object will later be mounted. The installer can visually estimate that prior to pressing the object against the wall that the object appears to be at a level position by standing back as the object is being pressed against the wall, and centering and leveling the object to an optimum position.

FIG. 6 is a front perspective view of the shelf 20 being removed from the wall 30, showing the wall mounted target patches 1' still attached to the wall. Since the stronger adhesive sides of the target patches are being pressed against the wall and the weaker adhesive sides of the target patches 1 is located between the target patches and the shelf object, the target patches 1 will transfer to the wall 30 as the object is being removed from the wall. FIG. 7 shows the target patches 1' now attached to the wall 30.

FIG. 8 shows traditional hanging fasteners 25, such as but not limited to nails, screws, and the like, being mounted through the central openings 8 of the target indicia on the target patches 1'. The target indicia 7 allows for the installer to easily attach the fastener 25 to the selected and desired mounting location on the wall 30.

Figure 9:
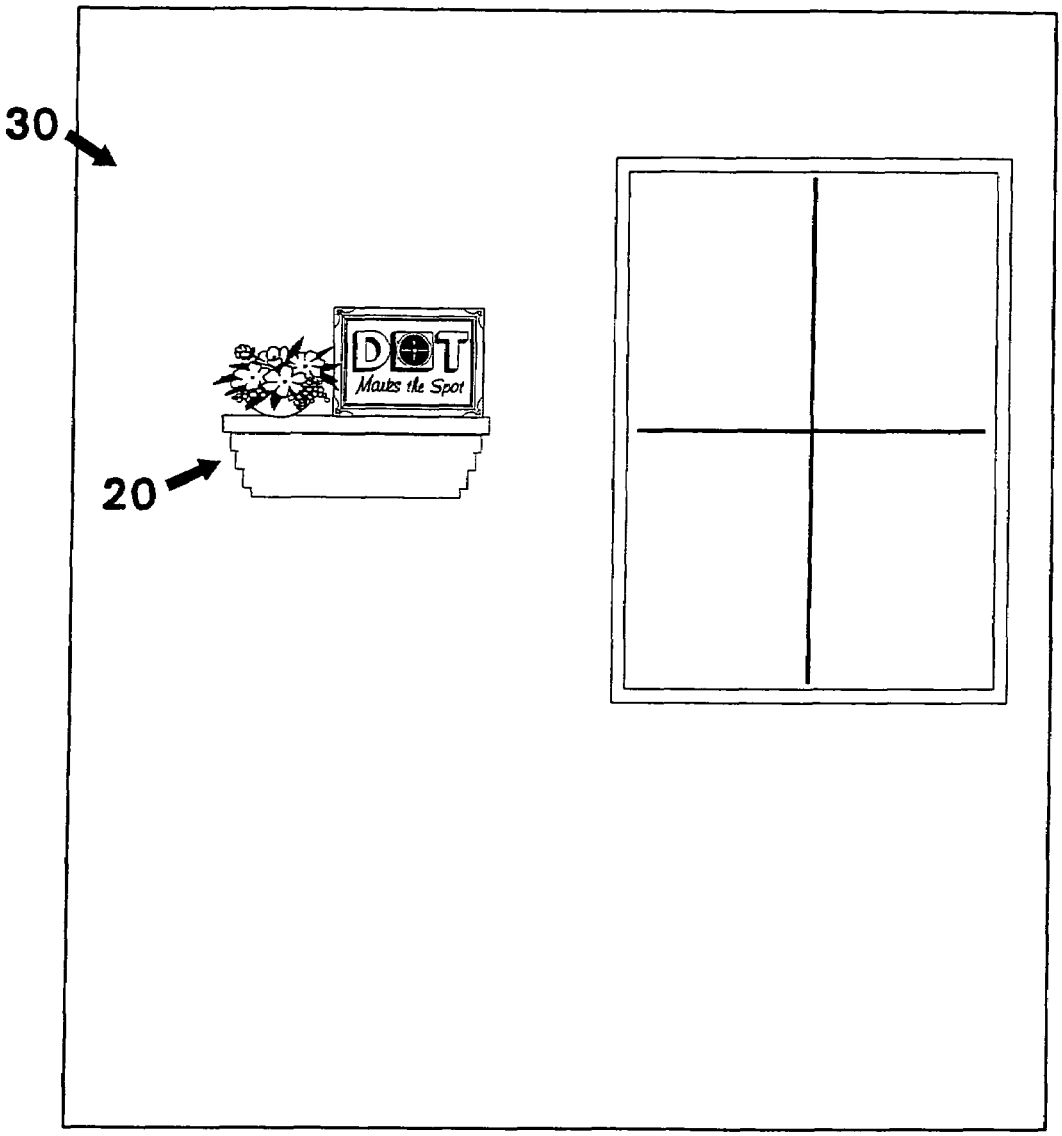
FIG. 9 is a perspective view of the shelf attached via the hanging fasteners to the wall.

The hanging fasteners 25 can be attached to the wall 30 by such techniques including but not limited to by a hammer, a drill, and the like. FIG. 9 is a perspective view of the shelf 20' of the preceding figures now attached via the hanging fasteners 25 to the wall 30 by hooking the heads of the wall mounted fasteners 25 to the keyhole slots on the rear of the shelf object 20.

Figure 10:
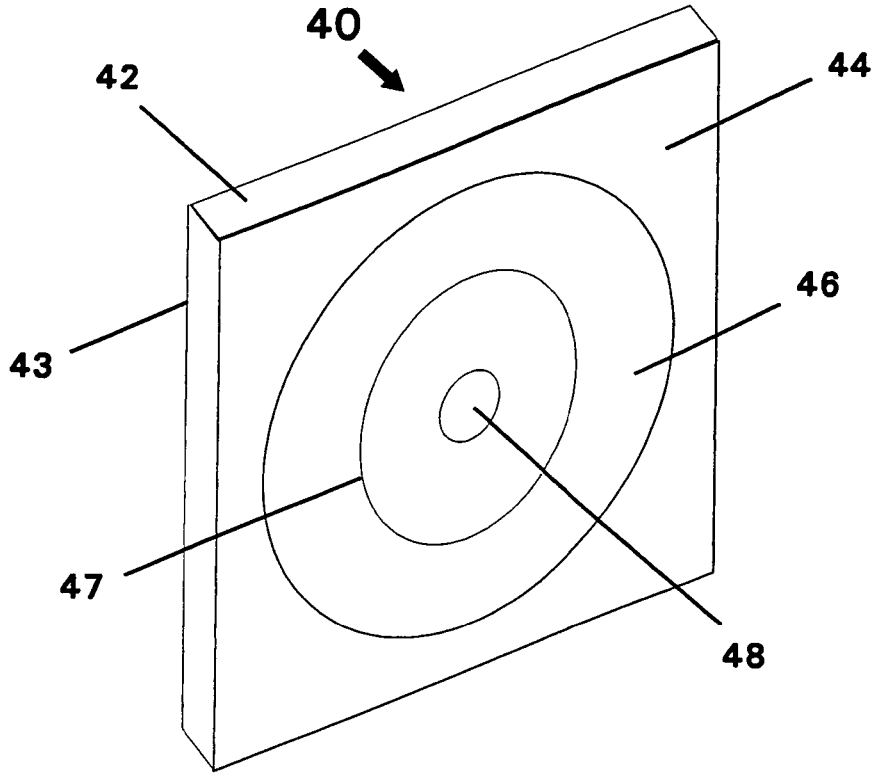
FIG. 10 is a perspective view of another target patch with concentric circles about an opening.
Figure 11:
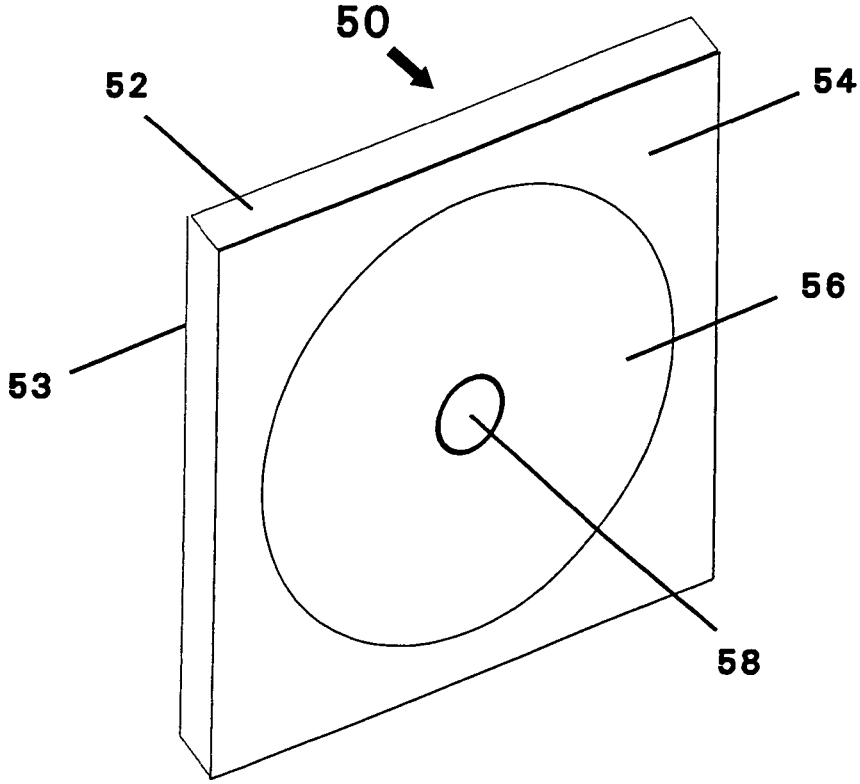
FIG. 11 is a perspective view of another target patch with a single central opening.

FIG. 10 is a perspective view of another target patch 40 with concentric circle(s) 47 in a bulls-eye configuration about an opening 48 through a central portion of the patch 40 for aiming and locating hanging fasteners. Target patch 40 can include portions 43, 44 and 46 which correspond to similar labels in the preceding figures.

F*ig*. 11 is a perspective view of another target patch 50 with a single central opening 58 therethrough for aiming and locating hanging fasteners. Target patch 50 can include portions 53, 54, 56 which correspond to similar labels in the preceding figures.

Figure 12:
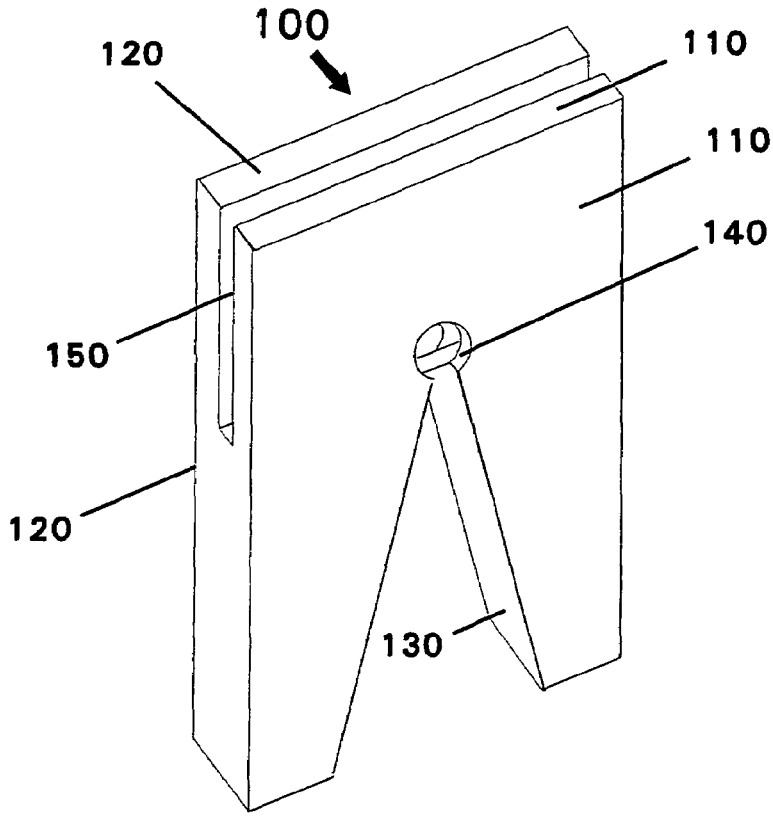
FIG. 12 is a front perspective view of another embodiment wire hanger patch.
Figure 13:
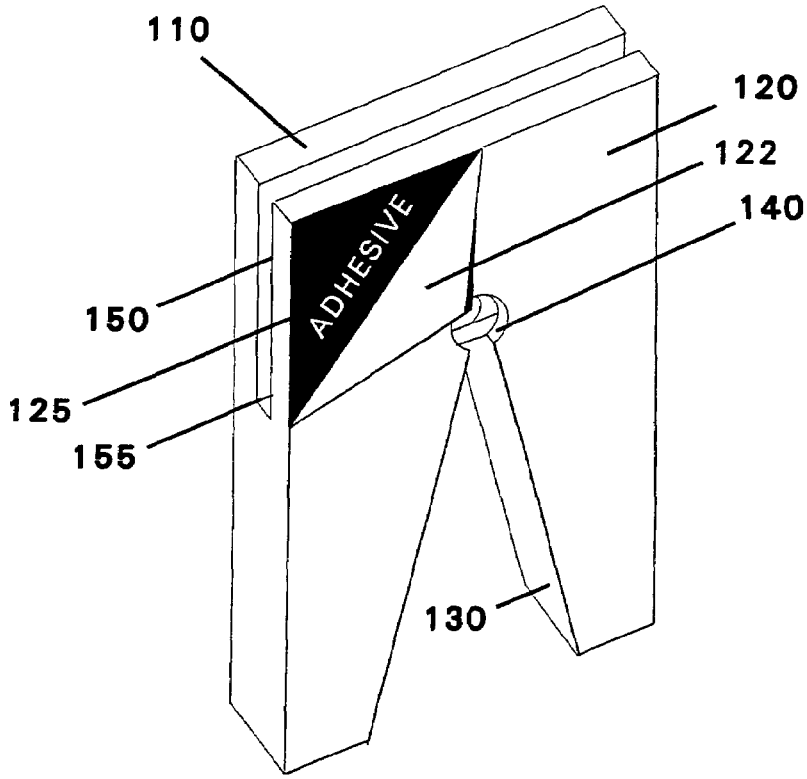
FIG. 13 is a rear perspective view of the wire hanger patch of FIG. 12.
Figure 14:
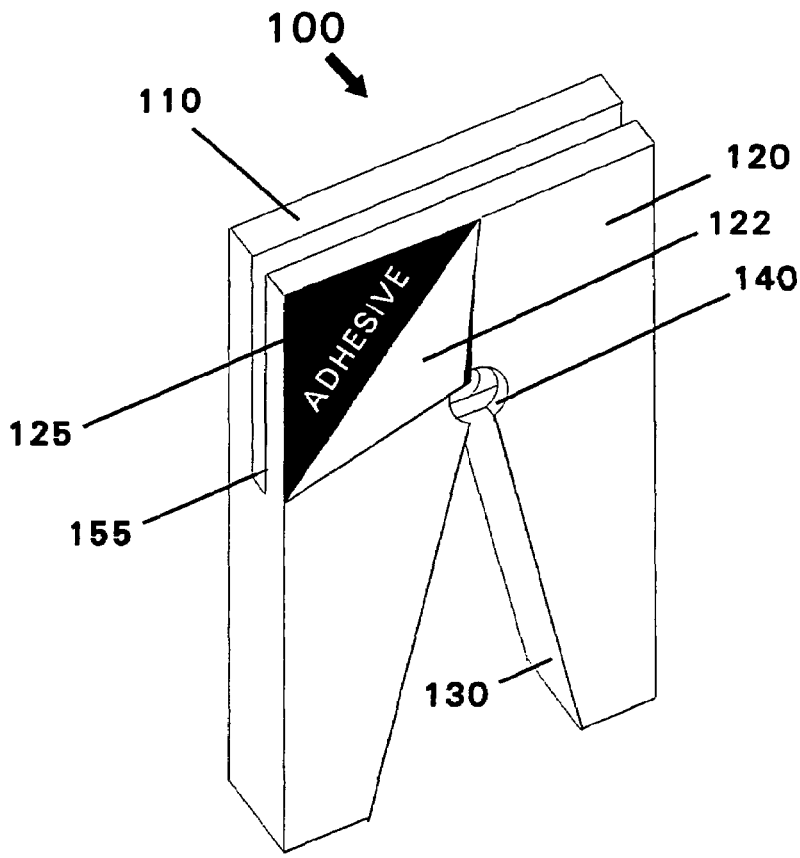
FIG. 14 is another rear view of the hanger patch of FIG. 13 with backing being peeled.

FIG. 12 is a front perspective view of another embodiment picture wire hanger patch 100. FIG. 13 is a rear perspective view of the wire hanger patch 100 of FIG. 12. FIG. 14 is another rear view of the hanger patch 100 of FIG. 13 with backing 120 being peeled off.

Referring to FIGS. 12-14, picture hanger patch 100 can be formed from a foam type plastic material having a generally rectangular shaped front side 110 and generally rectangular shaped back side 120, with a triangular shaped cut-out 130 from the bottom to approximately halfway up the patch 100. A central through-hole 140 can be located at the apex portion of the triangular cut-out 130. Located between upper portions of the front side 110 and back side 120 can be a grooved slot having a lower horizontal ledge type portion 155. An installer can remove a backing layer 122 from the back side 120 to reveal a sticky adhesive surface 125.

Figure 15:
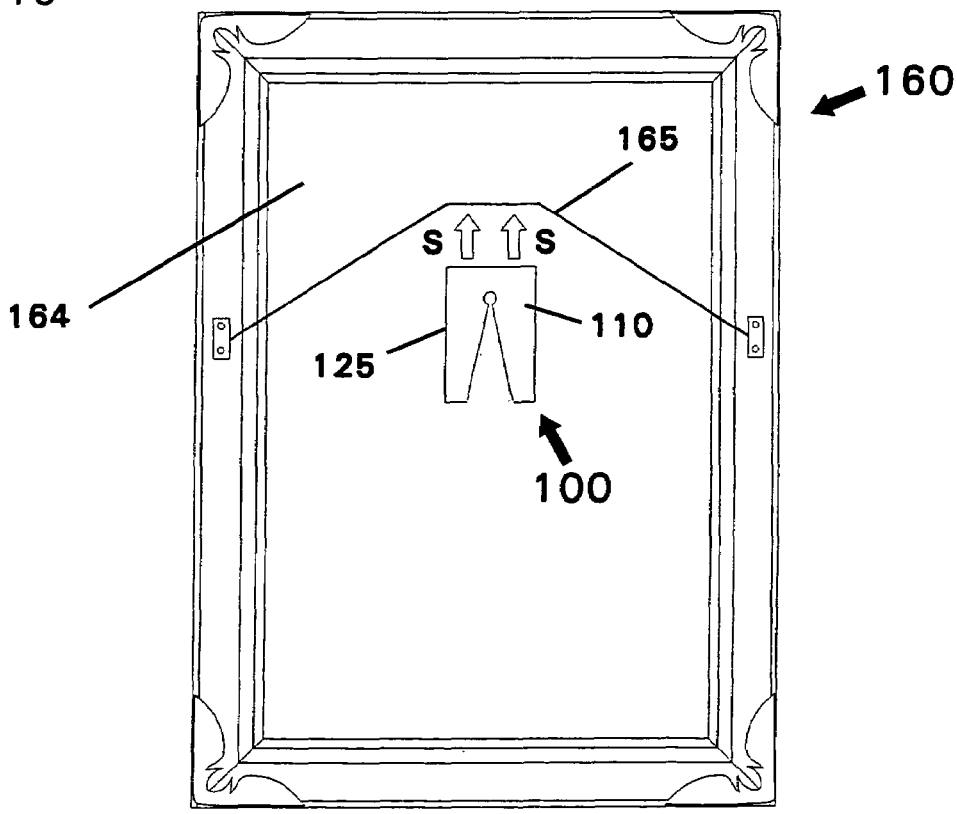
FIG. 15 is a rear view of a picture frame with the wire hanging patch being applied.

FIG. 15 is a rear view of a picture frame 160 having a traditional hanging wire 165. An installer can slide the picture hanging patch 100 upward in the direction of arrow S so that the grooved slot moves about a central portion of the hanging wire 165 until the hanging wire rests on the ledge portion 155.

FIG. 16A is a rear view of the picture frame with wire hanging patch 100' in place where the exposed sticky adhesive side surface 125 has been pressed against a rear side 164 of the picture frame 160. FIG. 16B is a side view of the picture frame 160 with the wire picture patch 100 of FIG. 16A along arrow 16B. The mounted hanging patch 100 now holds a central portion of the hanging wire 165 on ledge portion 155 within the grooved slot 150 of the mounted hanging patch 100'.

FIG. 17 is a perspective view of a sheet 9 of novel target patches 1 of the preceding figures. FIG. 17A is an enlarged view of a single target patch 1 having been peeled away from the sheet 9 shown in FIG. 17.

Figure 18:
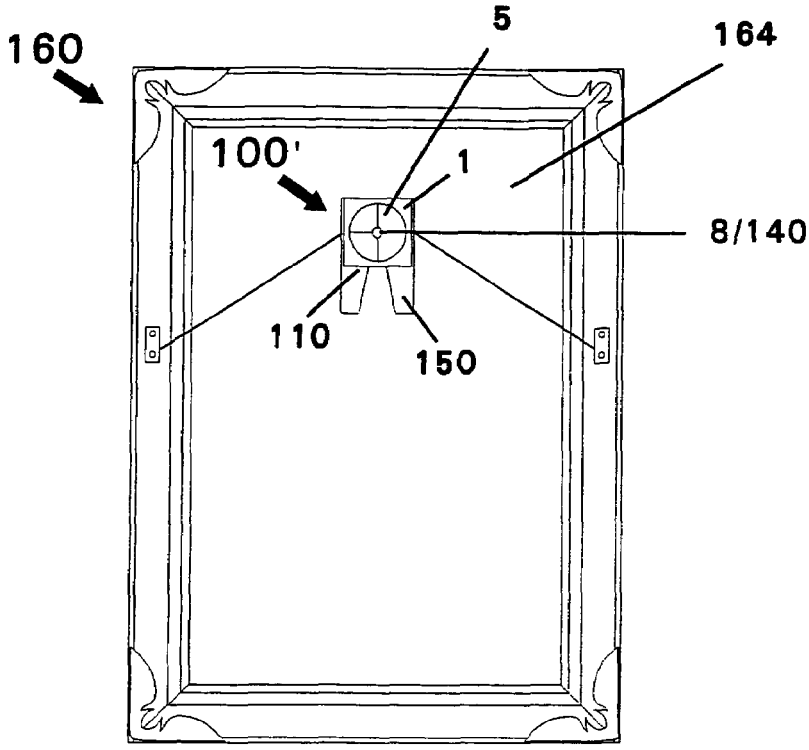
FIG. 18 is a rear view of the frame of the preceding figures with target patch applied to the wire hanging patch.

FIG. 18 is a rear view of the frame 160 of the preceding figures with target patch 1 applied to the front 110 of the mounted hanging patch 100, so that the through-hole 8 of the target patch is aligned with the through-hole 140 on the mounted picture hanging patch 100'. Here, just for purposes of illustration, rear exposed sticky surface 4 of the target patches can be placed against to overlap the through-hole 140 on the mounted picture hanging patch 100'. Next the backing layer 3 (shown in FIG. 1B) can be removed from the target patches 1 to remove another sticky surface 5.

Figure 19:
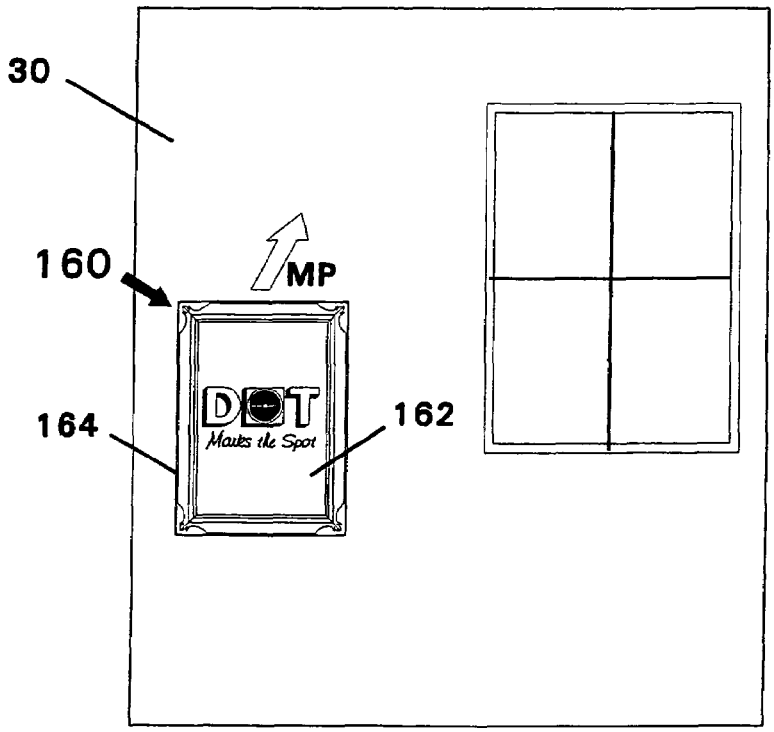
FIG. 19 a front perspective view of the picture frame about to be pressed against a wall.

Similar to the preceding figures the object to be hanged on the wall is positioned for temporary placement against wall so that the target patch 1 can be transferred to the wall. FIG. 19 a front perspective view of the picture frame 160 about to be pressed against a wall 30, by maneuvering a back side 164 of the picture frame 160 to a selected and level position on the wall 30 by moving the picture frame 160 in the direction of arrow MP to and against the wall 30, and finally pressing the picture frame 160 against the wall in order to transfer target patch 1 to the wall 30.

Figure 20:
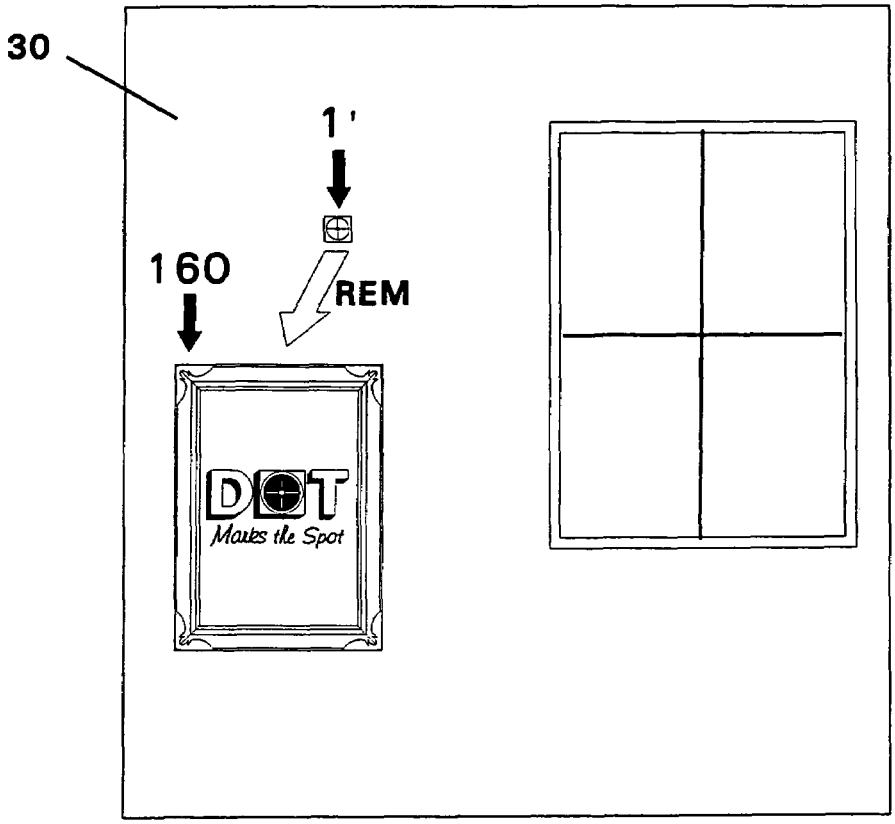
FIG. 20 is a front perspective view of the picture frame being removed from the wall.
Figure 21:
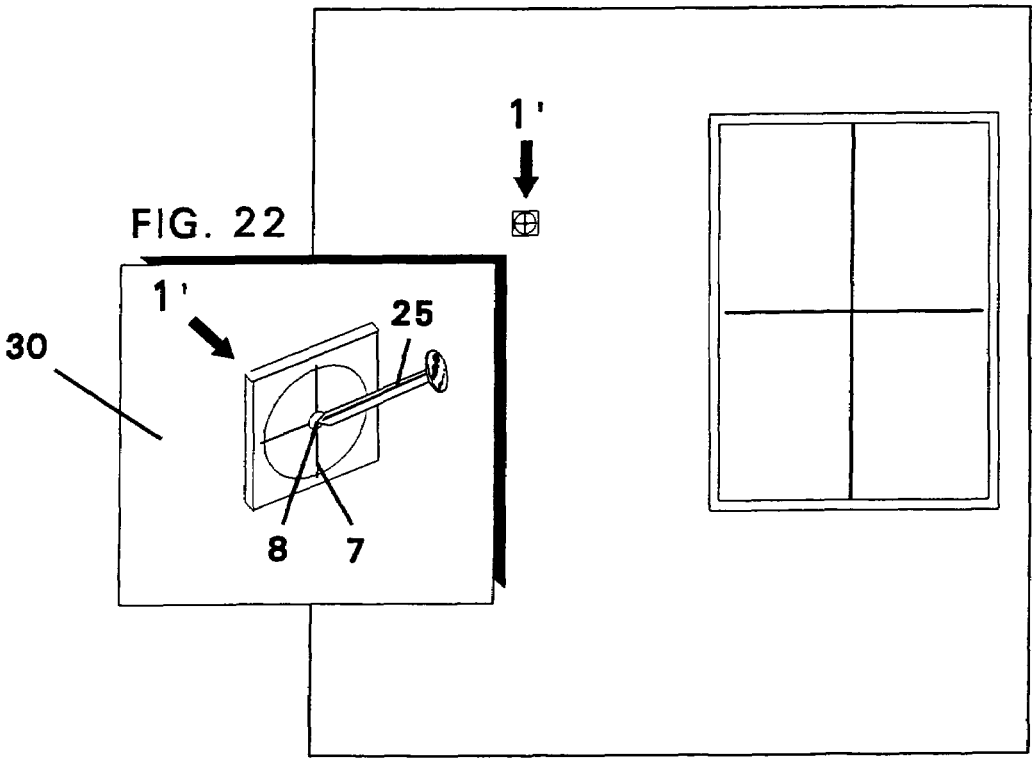
FIG. 21 shows the target patch of FIG. 20 now attached to the wall.

FIG. 20 is a front perspective view of the picture frame 160 being removed from the wall 30 in the direction of arrow REM. As previously described, the adhesive on side 5 is stronger than the adhesive side 4 of the target patch I so that removing the picture frame 160 allows for the target patch 1' to remain on the wall 30 in a desired location as shown by FIG. 21 where the target patch 1' is now attached to the wall 30.

FIG. 22 shows an enlarged view of a fastener 25 such as those described in reference to FIG. 8 now being inserted through the central opening 8 in the target indicia 7 on the wall attached target patch 1'. The target indicia 7 allows for the installer to easily attach the fastener 25 to the selected and desired mounting location on the wall 30.

Next the installer can take the picture frame 160 with the back side mounted picture mounted hanging patch 100', and slide the picture frame 160 down in the direction of arrow PS adjacent to the wall down over the wall mounted fastener 25 as shown in FIG. 23A. The triangular cut-out portion 150 (shown in FIG. 18) will orient and position the picture frame 160 about the mounted fastener 25 so that the head portion of the mounted fastener 25 rests against the through-hole 140 of the hanging patch 100' as shown in FIG. 23B.

FIG. 24 is a perspective view of a strip 200 of target patches described in the previous figures. FIG. 25 is a perspective view of a dispenser 300 such as but not limited to a plastic tape type dispenser for holding a rolled up strip of target patches.

The strips and rolls of the target patches can be separated by perforations between adjacent target patch. Alternatively, target patches can be cut from strips and rolls by scissors, and sharp cutting edges on tape type dispensers.

The target indicia of crossed lines, concentric circles and the like can be used directly with plastic or acrylic type tape, where a roll of tape can be dispensed and target portions can be selectively separated and applied behind an object to be wall mounted. The object can then be positioned and placed and pressed against a selected and desired location on a wall surface. Afterwhich the object is pulled away from the wall surface leaving behind the transferred target patch portion.

Fasteners such as nails, screws and the like, can then be attached through the center of the target indicia without causing unnecessary extra holes and damage to the wall surface. The object can then be easily mounted onto the wall mounted fasteners.

The invention can be practiced without central hole openings in the target patches. Also, the target indicia can include transferable printing, such as but not limited to printing found in ink stamps, and the like, where actual print transfers from one surface to another.

The novel invention can also be used with other types of hanging tools, such as but not limited to levelers, and the like. For example, a ruler shaped leveler having bubble levels, can be placed on the top of an object, such as a picture frame, or shelf, and as the object is being moved against the wall, the object can be further oriented so that the leveler tool shows the object to be in a level position prior to pressing the object against the wall.

The novel target patches can be part of a picture hanging kit where various numbers of target patches are included so that an installer can hang various objects such as picture frames, mirrors, curtain and shade rods, blinds, and the like, as well as wall mountable shelves, and the like.

Although the invention describes mounting to wall type vertical surfaces, the invention can be practiced on mounting objects to horizontal surfaces. For example, a surge protector, a speaker, furniture and or any other type of item that needs to be mounted to a floor surfaces, and/or to a raised horizontal surface, such as but not limited to a tabletop, desktop, countertop, and the like.

The invention can also be used with marking walls to locate studs, and the like, so that objects such as but not limited to cabinets, shelves, furniture, pictures, mirrors, and the like, can be attached to a stud type location in the wall.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A kit for mounting objects onto mounting surfaces, comprising:

a target patch having opposing sides with adhesive surfaces;

a backing sheet affixed to one of the opposing sides of the target patch;

a cover sheet affixed to another of the opposing sides of the target patch; and a permanent target of a single circular through-hole as a visible center-point on the target patch, wherein the target patch being placed on a visible exterior surface allows for positioning of a fastener through the visible center-point so that the kit determines a mounting position on a mounting surface where an object is mounted, and where no permanent indica markings are transferred to the mounting surface by using the target patch.

2. The kit of claim 1, wherein the target indicia surface further includes:

a bulls-eye target having concentric circles.

3. The kit of claim 1, wherein the targel indicia surface further includes:

a cross-hair configured target having a crossed lines.

4. The kit of claim 1, further comprising:

a wire hanging-patch having front and rear sides, the rear side placed on the back of the frame; and a triangular cut-out with an upper groove, wherein the upper groove on the hanging-patch catches and raises a hanging wire of the object to be hung before the target patch is used, and the frame is later hung by aiming and catching the triangular cut-out or the wire hanging patch to guide over an outer end of the fastener that is mounted on the wall surface.

5. The kit of claim 1, further including:

a sheet of individual target patches, each of the individual target patches having singular circular through-holes as visible center-points on each of the individual target patches.

6. The method of mounting objects having hanging wires, on wall surfaces, comprising the steps of:

providing an object to be hanged with a hanging wire;

providing a wire hanging-patch having a front side and a rear side, the rear side having a removable backing layer covering a sticky adhesive surface, the wire hanging-patch having an upper end with a groove, the wire hanging-patch having a lower end with a triangular cut-out;

removing the removable backing layer from the sticky adhesive surface of the hanging-wire patch;

catching and lifting the hanging wire of the object with the upper end of the groove to a raised position; and pressing the rear side of the hanging patch against a back of the frame having a hanging wire so that the hanging wire remains in the raised position.

7. The method of claim 6, further comprising the steps of:

aiming and positioning the triangular cut-out on the back of the object over an outer end or the fastener that is mounted on the visible exterior wall surface; and hanging the object with the hanging wire on the outer end of the fastener.

8. The method of claim 6, further comprising the steps of:

guiding the triangular cut-out on the back of the object over an outer end of the fastener that is mounted on the visible exterior wall surface; and hanging the object with the hanging wire on the outer end of the fastener.

9. A kit for hanging objects having hanging wires, comprising, a wire hanging-patch having front and rear sides; and a triangular cut-out with an upper groove, wherein the upper groove on the hanging-patch catches and raises a hanging wire on the object to be hung, and the frame is later hung by aiming the triangular cut-out on the back of the frame over an outer end of a fastener that is mounted on the wall surface.

10. The kit of claim 9, further comprising:

a removable backing layer covering a sticky adhesive surface on one of the sides of the hanging-patch, wherein the backing layer is removed from the hanging-patch before the object is to be hung.

* * * * *